US008487204B2

(12) United States Patent
Scola et al.

(10) Patent No.: US 8,487,204 B2
(45) Date of Patent: Jul. 16, 2013

(54) SINGLE POLE OR MULTI-POLE DOUBLE BREAK SWITCHING DEVICES

(75) Inventors: Edoardo Scola, Lecco (IT); Eligio Zanchi, Alzano Lombardo (IT)

(73) Assignee: ABB S.p.A., Milan (IT)

( * ) Notice: Subject to any disclaimer, the term of this patent is extended or adjusted under 35 U.S.C. 154(b) by 36 days.

(21) Appl. No.: 12/742,689

(22) PCT Filed: Oct. 28, 2008

(86) PCT No.: PCT/EP2008/064615
§ 371 (c)(1),
(2), (4) Date: May 13, 2010

(87) PCT Pub. No.: WO2009/065706
PCT Pub. Date: May 28, 2009

(65) Prior Publication Data

US 2010/0243610 A1 Sep. 30, 2010

(30) Foreign Application Priority Data

Nov. 21, 2007 (IT) ..... MI2007A002204

(51) Int. Cl.
*H01H 33/02* (2006.01)

(52) U.S. Cl.
USPC ..... 218/157; 335/202

(58) Field of Classification Search
USPC ..... 218/35, 157; 355/202, 8, 60
See application file for complete search history.

(56) References Cited

U.S. PATENT DOCUMENTS

| | | | | |
|---|---|---|---|---|
| 5,589,672 | A | 12/1996 | Uchida et al. | |
| 6,313,425 | B1 | 11/2001 | Doughty et al. | |
| 7,034,241 | B2 * | 4/2006 | Fleege et al. | 218/157 |
| 7,586,057 | B2 * | 9/2009 | Sisson et al. | 218/157 |
| 7,633,365 | B2 * | 12/2009 | Harmon et al. | 335/202 |
| 2008/0116173 | A1 * | 5/2008 | Sisson et al. | 218/157 |

FOREIGN PATENT DOCUMENTS

| | | |
|---|---|---|
| JP | 3-101018 | 4/1991 |
| WO | WO-2008/127491 A1 | 10/2008 |

* cited by examiner

*Primary Examiner* — Truc Nguyen
(74) *Attorney, Agent, or Firm* — Novak Druce Connolly Bove + Quigg LLP

(57) ABSTRACT

The present invention relates to a switching device, in particular an automatic switch, a disconnector or a contactor, with high dependability, for use preferably in low voltage electrical systems. In particular the invention relates to a single-pole or multi-pole double break switching device for low voltage systems comprising, for each pole, at least a first pair of contacts and at least a second pair of contacts. Each pair comprises a stationary contact and a movable contact which can be reciprocally coupled/decoupled at the level of a first breaking cavity and a second breaking cavity respectively. Said cavities are defined inside a casing which comprises a first surface with respect to which an internally hollow portion protrudes, said internally hollow being integrally made with at least one portion of the casing. The hollow portion defines, for each pole, one or more discharge channels each of which has a first section communicating with the corresponding first breaking cavity and a second section communicating with the environment outside the casing to permit the discharge of gas from the inside of the first breaking cavity.

18 Claims, 5 Drawing Sheets

SINGLE POLE OR MULTI-POLE DOUBLE BREAK SWITCHING DEVICES

CROSS REFERENCE TO RELATED APPLICATIONS

This application is a National Phase filing under 35 U.S.C. §371 of International Application No. PCT/EP2008/064615, filed Oct. 28, 2008, which claims priority to Italian Patent Application No. MI2007A002204, filed Nov. 21, 2007. The entire contents of each of the above-applications are incorporated herein by reference.

The present invention relates to a switching device, in particular an automatic switch, a disconnector or a contactor, with high dependability, for use preferably in low voltage electrical systems. In particular the invention relates to a single-pole or multi-pole double break switching device.

It is known that switching devices (for example automatic switches, disconnectors and contactors), hereinafter referred to for the sake of brevity as switches, comprise a casing and one or more electrical poles, each of which is combined with at least one pair of contacts which can be reciprocally coupled/decoupled from each other. The switches of the known art also comprise control means which determine the relative movement of the contact pairs to at least one first connection position (circuit closed) and one second separation position (circuit open).

Each pole of the switch is generally combined with at least one breaking cavity, i.e. a space particularly suitable for extinguishing the electric arc. The breaking cavities can be simple regions obtained in the switch casing or they can comprise various elements, also called arc chambers, for example in the form of casings made of insulating material provided with arc breakers. The most advanced arc chambers, also called modular chambers, have the advantage of being easily replaceable and can be made of more suitable materials than, for example, those used for the switch casing.

Generally the reciprocally couplable/decouplable pairs of contacts consist of first elements, substantially stationary (the stationary contacts) and second elements which are movable (the movable contacts). The control means comprise mechanisms which terminate, for example, in a main shaft operatively connected to said movable contacts.

Solutions exist in which the main shaft and the movable contacts are integrated in one single part, the so-called rotating moving element. Said element, made of insulating material, must guarantee both the electrical insulation between the phases and, naturally, must correctly transmit the movements to the movable contacts and maintain the forces involved. The switches of this type have considerable advantages, for example a limited number of parts and limited overall dimensions.

The shaft or rotating element is usually connected to the switch casing by means of bearings. In switches with main shaft of traditional type, the movable contacts are distributed between different movable supports, corresponding to each pole; in switches with moving element, the movable contacts are mounted in apertures provided in the moving element itself.

As is known, during the working life of a switch, phenomena can occur which expose the switch and the network to particularly severe stress. This occurs firstly when the switch is required to withstand, albeit for a brief period, currents higher than the rated values. The length of time the switch and electrical network are exposed to an overcurrent (for example an overload or short circuit) depends on the natural duration of the event or, more likely, on the time required by the protection devices to effectively set the switch to safe conditions, i.e. to interrupt the overcurrent. The interruption of an overcurrent is a complex phenomenon. In technical terms, the capacity of the switch to interrupt currents of a certain level is defined as breaking capacity whereas the capacity of the switch to withstand currents much higher than the rated current for brief periods is defined as electrodynamic strength.

The energy that flows and is dissipated in the switch and in the electrical network during an overcurrent event causes damage, the extent of which depends both on the intensity of the current and the duration of the phenomenon, until the fault current has been completely interrupted. The most common damage can consist in premature decay of the characteristics of the components exposed and therefore deterioration in the performance of the switch and the electric network. In some cases, flashes can even occur due to the high temperatures reached.

As is known, in order to limit the occurrence of damage to both the electric network and the switch itself or parts of it (contact plates, arc chamber, control, insulating elements), many stratagems have been experimented and developed to make the interruption as rapid and effective as possible. In some solutions, for example, gasifying means and/or materials are used, able to release extinguishing or fireproof substances in the vicinity of the breaking cavity or the area in which the electric arc forms. Other solutions advantageously exploit or control in various ways the electromagnetic phenomena that develop in the electric arc breaking cavity.

Other solutions variously connect the breaking cavities to the external environment with respect to the switch casing; for this purpose apertures are made or passages provided for venting the gases produced during interruption of the electric arc. The gases, in turn, can be appropriately deionised and/or cooled and/or filtered by means of further contrivances to ensure that the substances flowing out of the switch body are as inert as possible.

In the case of single-break switches, the breaking cavities are typically located in a relatively "high" part of the equipment, hence venting of the gases can be guaranteed by the provision of characteristic apertures in the vicinity of the upper electrodes.

In the case of double break switches, on the other hand (i.e. provided with at least one pair of arc chambers at top and bottom), for each pole there is normally the problem of how to vent the gases from the lower breaking cavities. Normally, in the lower part of the switches a container is provided which houses, for example, a protection device or alternatively connection means between the conduction electrodes and the conduction bars. Due to the presence of these containers, the lower breaking cavities are normally in an intermediate position of the switch, hence relatively far from the corresponding lower electrodes or terminals. Therefore for venting of the gases, solutions structurally analogous to those provided for the upper breaking cavities cannot normally be used.

Discarding solutions that are functionally valid but unsatisfactory from a plant engineering point of view (for example solutions with rear and/or lateral vents), the majority of solutions feature vents that discharge the gases into the lower part of the switch. Said solutions, developed in an attempt to overcome the difficulties listed above, are not without drawbacks, however.

In the U.S. Pat. Nos. 7,034,241 and 6,188,036, for example, the switch comprises an external box which defines, for each pole, a seat that houses the casing containing the pole. The external box is structured so as to define, for each pole, channels for venting the gases coming from the inside of the corresponding container casings, following interruption events.

In further detail, in these solutions the discharge channels therefore consist of at least two separate parts, the first of which is defined by the configuration of the casing of each pole, and the second by the external box in which the protection device is housed. Said solution necessarily requires an impeccable level of finish and perfect condition during normal operation of the switch. Any inaccuracies in coupling between the casing and the external box can cause leaks of high temperature or ionised gases, exposing the adjacent parts to risk, for example the protection relay or other devices installed beside the switch or inside its casing. Consequently in these solutions, assembly and formation of the vent channels are critical operations that require precision and therefore involve high production costs. The farther the breaking cavities from the lower side of the switch, i.e. the more extensive and complex the configuration of the vent channels, the higher these costs.

In another known solution described in the patent application EP1098330, a covering and extension element is combined with the switch at the bottom, insulating the electrical parts of the switch and at the same time defining the gas discharge channels. In order to guarantee its integrity, the entire covering element must be made of relatively high quality material in order to resist the effects of the gases. Similar problems are encountered in the known solutions in which the discharge channels are defined by the coupling between shaped parts of the switch casing and the container in which the protection device is enclosed.

It should also be noted that in all the solutions cited above, the dependability of the switch is relatively limited as the risks due to leaks of high temperature or ionised gases towards internal areas of the switch can cause malfunctioning or non-opening. Said episodes can lead to decay of the switch components, for example, due to successive deposits of sublimed or evaporated metallic material on sensitive parts. Said decay can result in a dangerous reduction of the insulation characteristics between the phases or interference with the mechanical functions of the device.

On the basis of these considerations there is a for alternative solutions able to overcome the above limits and problems. Therefore the main aim of the present invention is to provide a single-pole or multi-pole double break switching device which overcomes said drawbacks.

In this context, one object of the present invention is to provide a double break switching device which permits effective discharge of the gases from the lower breaking cavity/cavities in conditions of complete safety.

A further object of the present invention is to provide a switching device which permits discharge of the gases from the lower breaking cavity/cavities via a relatively limited number of elements that can be easily obtained without requiring complex and precise assembly operations.

A further object of the present invention is to provide a switching device in which said discharge of the gases from the lower breaking cavities is safe and risk-free for operation of the other component parts of the switch or other devices installed beside the switch.

Last but not least, a further object of the present invention is to provide a switching device that is dependable and relatively easy to produce at competitive costs. This aim and said further objects which will be illustrated in greater detail in the course of the present invention are achieved via a single-pole or multi-pole double break switching device for low voltage systems comprising for each pole at least a first pair of contacts and at least a second pair of contacts. Each pair of contacts comprises a stationary contact and a movable contact, which can be reciprocally coupled/decoupled respectively at the level of a first breaking cavity and a second breaking cavity. The switching device comprises at least a first casing inside which the breaking cavities are configured.

The device according to the invention is characterised in that the first casing comprises a first surface with respect to which an internally hollow portion protrudes, said internally hollow portion comprising, for each pole, one or more exhaust channels. Each of these channels is provided with a first section communicating with a corresponding first breaking cavity and a second section, opposite the first section, communicating with the environment outside the first casing in order to permit the discharge of gases from the inside of said first cavity. The internally hollow portion is integrally made with at least one portion of the first casing and the first breaking cavity is positioned between the second breaking cavity and said first surface.

According to a first advantageous aspect of the present invention, the exhaust channels for discharge of the gases from the first breaking cavities arc entirely comprised in the casing which defines said first cavities. In practice each of the latter is connected to the external environment via one or more discharge channels which develop without interruption between the two opposite sections, permitting safe inert discharge vis-à-vis the other components of the switching device.

The outer surfaces of the internally hollow part physically insulate the discharge channels from the external environment maintaining the integrity, for example, of a further casing inside which auxiliary and/or accessory devices of the switching device can be housed. One advantage of this is that relatively low quality materials can be used to produce said further casing with respect to those used for production of the discharge channels.

Further characteristics and advantages will become clearer from the description of preferred but not exclusive embodiments of the switching device according to the present invention, illustrated by way of non-limiting example in the accompanying drawings in which.

Figure 1:
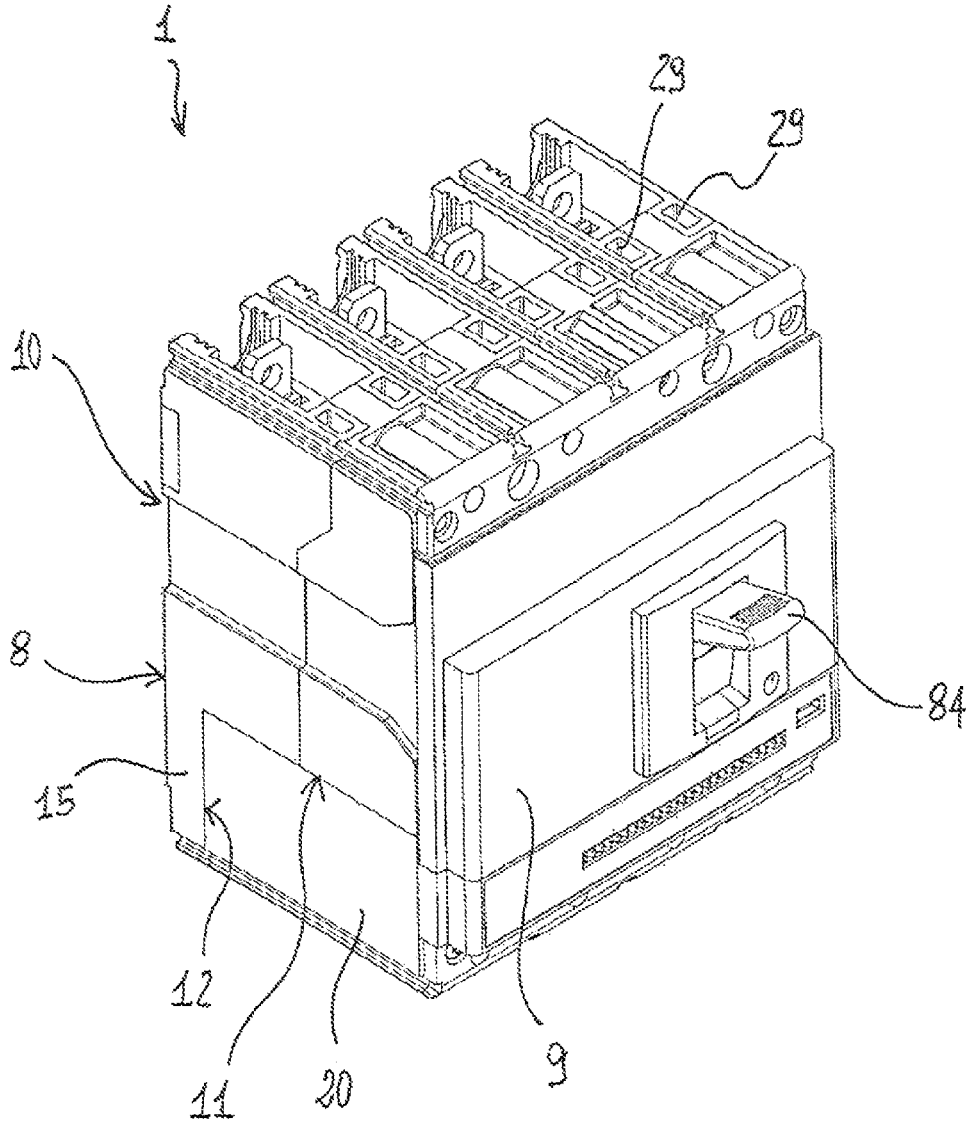
FIG. 1 is a perspective view of an embodiment of a switching device according to the present invention.

With reference to the figures cited, the switching device 1 according to the invention can consist of one single pole or alternatively a plurality of poles, depending on requirements. The figures show a multi-pole switching device and in the case in point an automatic switch with four poles. It is understood, however, that the principles and technical solutions presented below apply also to other types of switching device, for example disconnectors or contactors having any number of poles.

The switching device 1 according to the invention comprises, for each pole, at least a first pair of contacts and at least a second pair of contacts which can be reciprocally coupled/decoupled to/from each other. In detail each pair of contacts comprises a stationary contact 90 and a movable contact 91. The movable contacts 91 of each pair rotate preferably around the same axis of rotation 101, but they could also rotate around independent axes of rotation. The contacts of the first pair of contacts couple/decouple at the level of a first, lower, breaking cavity 30, and the contacts of the second pair of contacts couple/decouple at the level of a second, upper, breaking cavity 40 (see FIG. 2).

The device 1 comprises at least a first casing 10 inside which the first breaking cavity 30 and the second breaking cavity 40 are configured, for each pole. The device 1 according to the invention is characterised in that the first casing 10 comprises a first surface 11 with respect to which an internally hollow portion 15 protrudes; the internally hollow portion 15 comprises, for each pole of the device 1, one or more exhaust channels 24, each of which is provided with a first section 25 communicating with the corresponding first cavity 30. For each channel 24, said first section 25 constitutes in practice the inlet section into the channel for the gases generated inside the first breaking cavity 30 following an interruption event.

Each channel is provided with a second section 26, opposite the first section 25, which communicates with the environment outside the first casing 10 to allow said gases to be discharged into the atmosphere. The first breaking cavity 30 is positioned between the second breaking cavity 40 and said first surface 11. Furthermore, according to the invention, the internally hollow part 15 is advantageously integrally made (i.e. in one single piece) with at least one portion of the first casing 10 in order to increase the physical continuity of the structure of the device 1.

With reference to a vertical installation of the device 1, like the one illustrated in the figures from 1 to 5, the first breaking cavity 30 and the second breaking cavity 40 can be considered a lower and an upper breaking cavity respectively with respect to the axis of rotation 101 of the movable contacts 91. Consequently the first surface 11 is identified as the lower surface of the first casing 10 with respect to which the lower cavity (first breaking cavity 30) is positioned between the upper breaking cavity (second breaking cavity 40) and the same lower surface (first surface 11).

The discharge channels 24 according to the invention are therefore included in the structure of the first casing 10 which configures, for each pole, the first breaking cavity 30. In particular said channels 24 develop without physical interruptions between said first section 25 and said second section 26 so that the corresponding inner walls have no discontinuity between the two sections 25, 26. Discontinuity is intended as a physical interruption such as a joint between two walls in contact. During discharge of the gases, this technical solution allows the gases to be kept hermetically isolated inside the channels 24, i.e. isolated from the other components of the switching device 1. Unlike the current solutions, the structure of the channels 24, since there are no physical interruptions between the two sections 25 and 26, prevents any leaks of gas towards other components of the switch or towards other adjacent devices.

As already underlined above, the figures from 1 to 5 illustrate a switching device 1 according to a substantially vertical mode of installation. In said regard and solely for descriptive purposes, the first breaking cavity 30 and the second breaking cavity 40 will also be indicated below by the expressions "lower breaking cavity 30" and "upper breaking cavity 40" respectively. Analogously the first surface 11 will, in the course of the description, also be indicated by the expression "lower surface 11".

FIG. 1 is a perspective view of a possible embodiment of the switching device 1 according to which the first casing 10 comprises a back surface 8 (substantially perpendicular to said lower surface 11) and a fore surface 9 opposite the back surface 8 (also substantially perpendicular to said surface 11). As illustrated, the internally hollow portion 15 emerges transversally with respect to the lower surface 11 of the first casing 10, i.e. the same develops according to a plane substantially perpendicular to said lower surface 11.

In further detail, the internally hollow portion 15 develops so as to be delimited at the rear by the back surface 8 and at the front by a front surface 12 which is substantially perpendicular to the lower surface 11. In particular, according to this particular configuration, the internally hollow portion 15 protrudes so as to give a part of the first casing 10 a substantially L-shaped form. Via this configuration the outlet section of the discharge channels 24 (above indicated also as second section 26) is arranged in a position relatively far from the lower surface 11 allowing substantially vertical discharge of the gases when the device 1 is installed as illustrated.

The first casing 10 is preferably configured so that, for each pole, the lower breaking cavity 30 is delimited, on one side, by the lower surface 11. Via this solution, the first section 25 of the discharge channels 12 is operatively positioned at a level near to that of said lower surface 11. In other words, the discharge channels 24 develop completely on the outside of the portion of the first casing 10 which will contain the double break components. In this way, the reliability and safety of the switching device 1 are favourably maintained.

Figure 2:
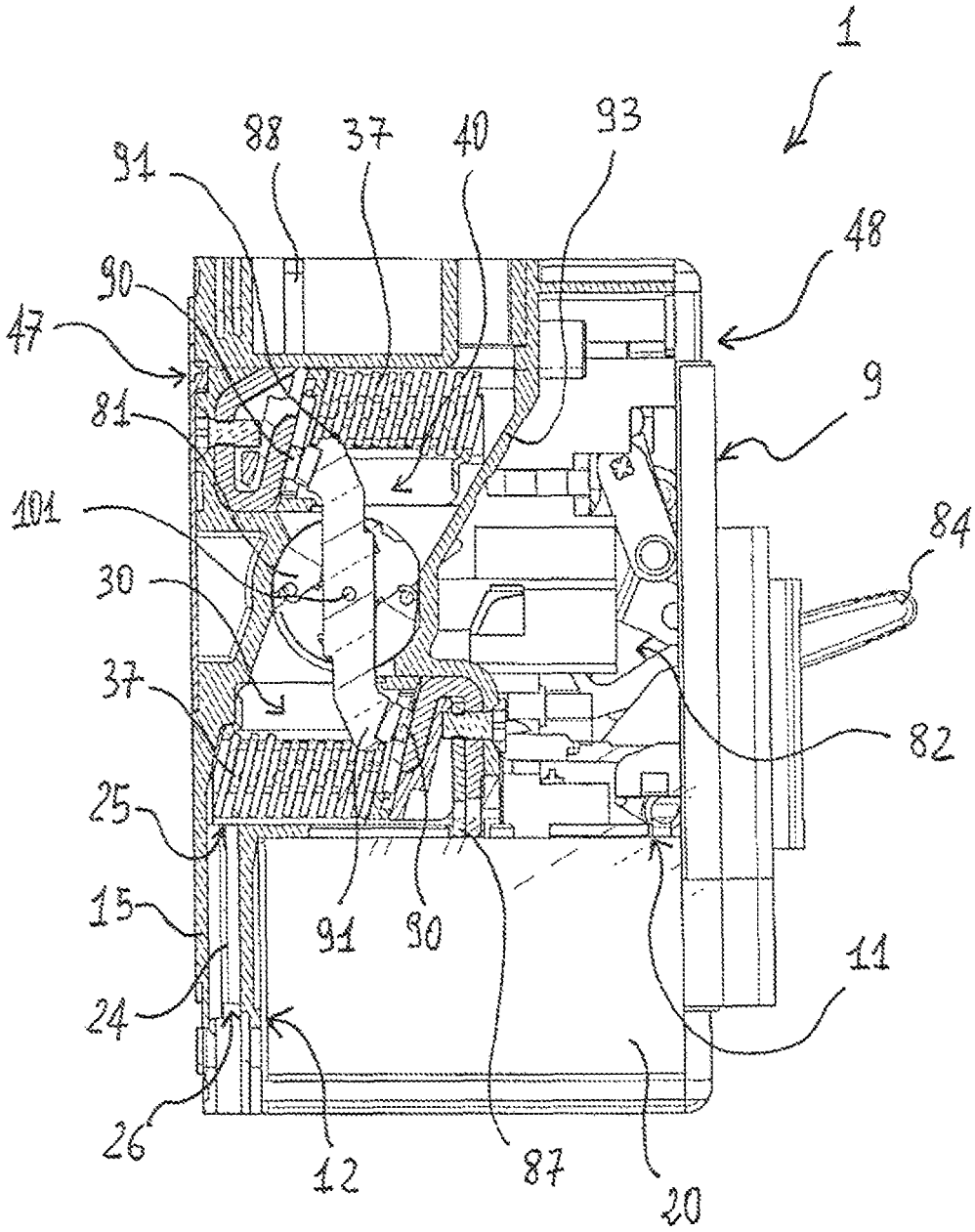
FIG. 2 is a lateral section view of the switching device of FIG. 1.

FIG. 2 is a section view of the switching device of FIG. 1 illustrating further advantages of the present invention. As already indicated above, the internally hollow part 15 is advantageously integrally made, in one single piece, with at least one portion of the first casing 10 in order to increase the physical continuity of the structure of the device 1. In other words, via this solution the discharge channels 24 are produced so that they adjoin the lower breaking cavities 30, for example via a moulding process. Production times and costs are thus advantageously limited.

According to a preferred embodiment of the invention, the switching device 1 preferably also comprises a second casing 20 which can contain, for example, one or more auxiliary and/or accessory devices of the switching device 1. In the event of the latter being an automatic switch, the second module 20 could contain, for example, an electronic or thermomagnetic protection relay. If, on the other hand, the switching device 1 is configured as a disconnector, then the second module 20 could contain a set of electric junctions which connect the lower electrodes 87 of the disconnector to conduction bars and/or clamps or terminals for the external connection.

As illustrated, the second casing 20 is coupled with the first casing 10 at the level of the lower surface 11 and/or of the front surface 12 of the internally hollow portion 15. In particular, according to a preferred embodiment of the invention, the second casing 20 is coupled in a removable manner with the first casing 10 in order to permit independent replacement and/or maintenance of the two casings 10 and 20. In detail, the latter are preferably coupled so that the second casing 20 is operatively positioned below the first casing 10. More precisely, the second casing 20 has a substantially prismatic configuration which extends so as to be geometrically complementary to the L-shaped configuration of the first casing 10, thus obtaining an extremely compact configuration of the switching device 1.

As said, the front surface 12 of the internally hollow portion 15 can therefore be advantageously used as a coupling surface between the two casings 10 and 20. This means that the second casing 20 is physically isolated from the discharge channels 24 configured inside the hollow portion 15. In practical terms this aspect translates into the advantage that the second casing 20 can be produced in a relatively lower quality material with respect to the one used for the first casing 10. As already indicated above, the lateral walls that delimit the discharge channels 24 are defined solely by the structure of the hollow portion 15.

Figure 3:
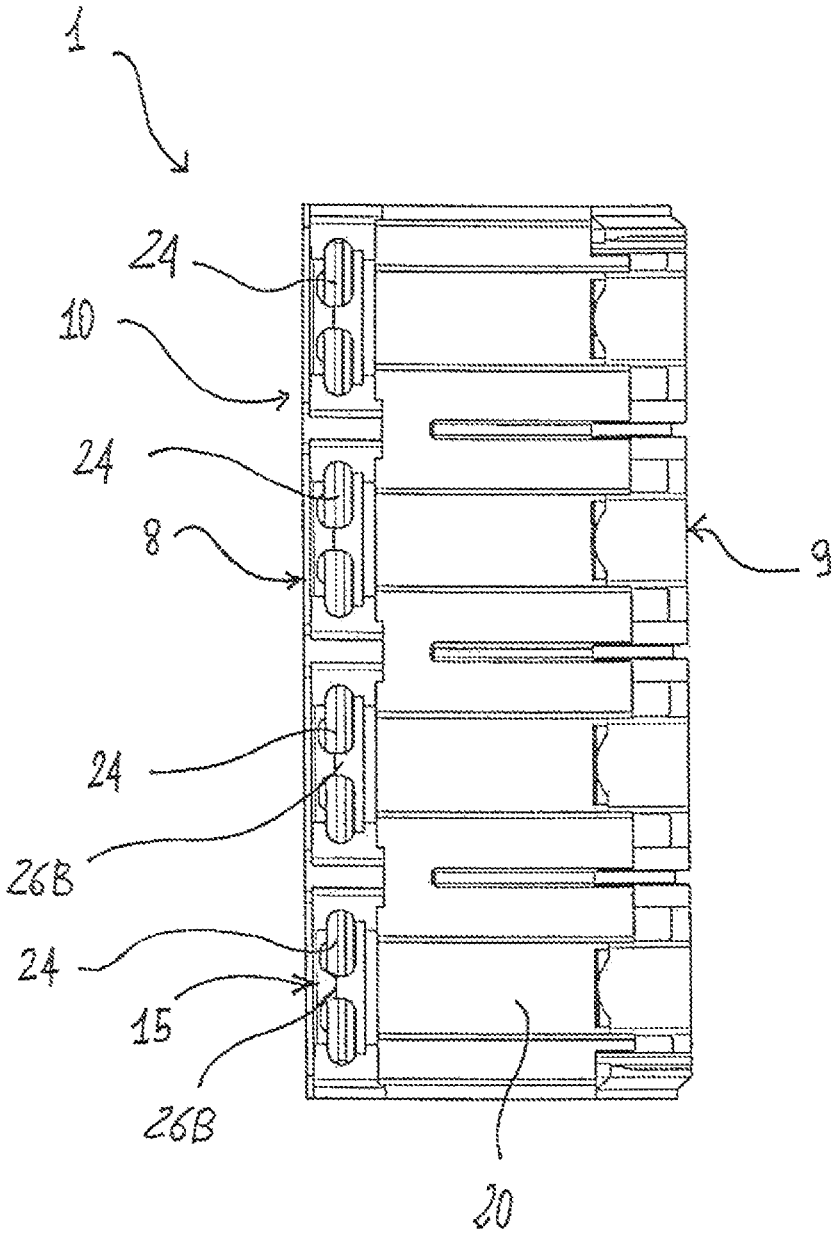
FIG. 3 is a view from below of the switching device of FIG. 1.

FIG. 3 is a view from below of the switching device 1 of FIG. 1 which shows in detail a possible embodiment of the present invention. As illustrated, for each pole of the switch, the internally hollow portion 15 configures a single discharge channel 24 which runs from the first section 25 communicating with the corresponding lower breaking cavity 30 to the second section 26 communicating with the environment outside the first casing 10. In particular the second section 26 is split into two portions divided by a transverse wall 26B so as to split the flow of gas discharged into two parts.

Said transverse wall 26B can be advantageously made of a material such as to alter the chemical-physical characteristics of the gas discharged, making them more acceptable for discharge into the atmosphere, for example in terms of temperature and composition. Using metallic material it is possible, for example, to lower the gas discharge temperature. Use of plastic material, on the other hand, with gasifying properties, permits variation of the composition of the gas, limiting for example the possible formation of flames during discharge. The expression "gasifying properties" indicates the capacity of the plastic to release, following the heating produced by the gases, fireproof substances which alter the chemical characteristics of the gases.

More generally, the switching device 1 preferably comprises means for altering the chemical-physical characteristics of the gases discharged via the discharge channels 24. Said means can comprise, for example, separation walls arranged inside the discharge channels 24 and made of metallic material or alternatively of gasifying plastic material. In particular said separation walls could be advantageously obtained or inserted in the discharge channels during formation of the same, for example during moulding of the internally hollow part 15. The transverse walls 26B present in the solution illustrated and described above should also be considered a possible embodiment of the means in question.

In a possible alternative embodiment, the means for altering the chemical-physical characteristics of the gases discharged could comprise gasifying coatings (for example paints) applied to the internal surfaces of the discharge channels 24 or to the surfaces that delimit the lower breaking cavities 30.

Obviously the embodiments described are possible embodiments of the means for altering the chemical-physical characteristics of the gases discharged. Other functionally equivalent embodiments should be considered as falling within the scope of the present invention.

According to a preferred embodiment of the invention, the first casing 10 could advantageously be entirely produced by moulding of plastic with gasifying properties. In this way all the parts heated directly or indirectly by the gases could advantageously contribute to altering the chemical-physical characteristics of the gases.

With reference again to the view of FIG. 2, the switching device 1 comprises a moving element 81 on which the movable contacts 91 are mounted. Said moving element 81 defines the axis of rotation 101 of the movable contacts 91 and is operatively positioned between the lower breaking cavity 30 and the upper breaking cavity 40, each of which houses, preferably in a removable manner, a corresponding arc chamber provided with metal plates 37 acting as arc breakers. Inside each breaking cavity 30, 40 is a corresponding stationary contact 90 in turn electrically connected to an upper electrode 88 or to a lower electrode 87 according to known construction methods.

The moving element 81 is operatively connected to a control mechanism 82 which operates it. In the case of automatic switches, the control mechanism 82 is operatively connected to a protection device (for example an electronic relay positioned inside the second casing 20) which controls its operation in the event of a short circuit, for example.

According to a preferred embodiment of the invention, the first casing 10 of the switching device 1 configures, for each pole, one or more upper vents 29 for discharge of the gases from the corresponding upper breaking cavity 40 (see FIG. 1). With reference to the solution illustrated, the first casing 10 configures for example two upper vents for each pole, i.e. for each upper breaking cavity 40 configured by the same casing. Obviously the embodiment illustrated should be considered an example and can therefore be replaced with further known embodiments.

Figure 4:
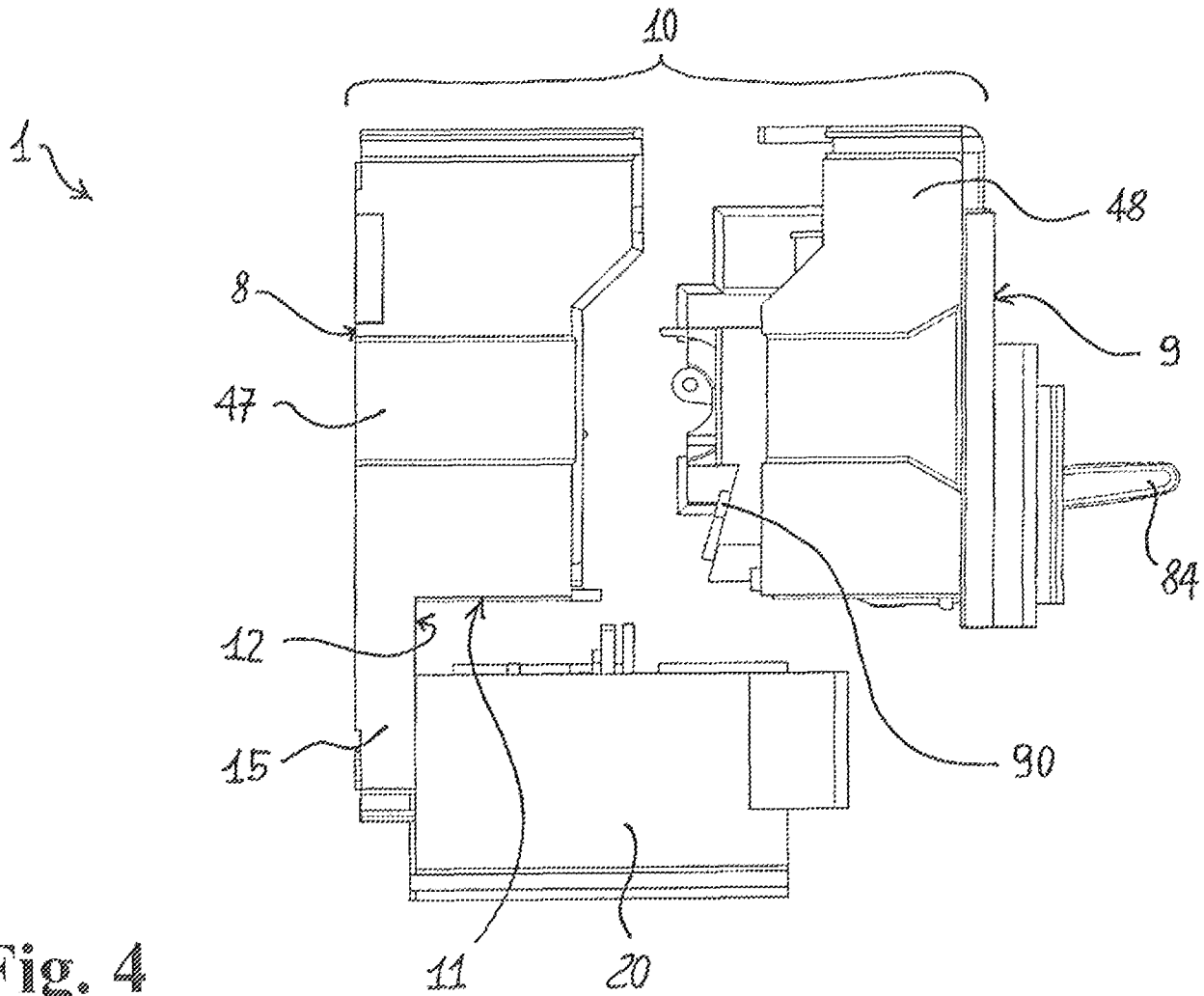
FIGS. 4 and 5 are an exploded lateral view and an exploded view in perspective of the switching device of FIG. 1.
Figure 5:
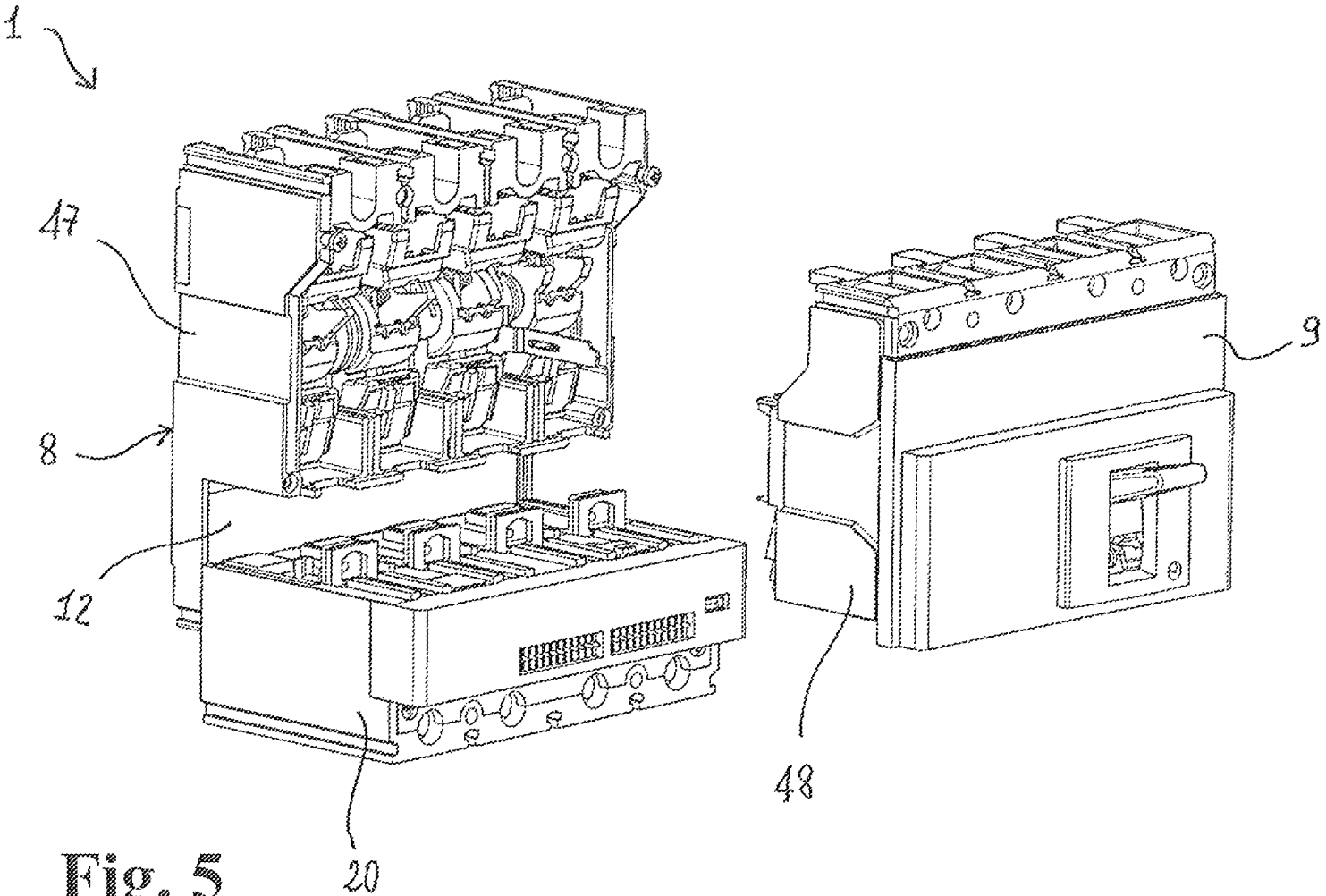

FIGS. 4 and 5 are exploded views, according to different observation points, of the switching device illustrated in FIG. 1. As illustrated, the first casing 10 consists of a rear portion 47 and an front portion 48 operatively connected in a removable manner to said rear portion 47. The possibility of removing said coupling advantageously results in easier inspection and/or replacement of the components of the device 1 such as, for example, the arc chambers housed in the corresponding breaking cavities 30, 40.

In the solution illustrated, the two portions 47, 48 are configured so that the internally hollow portion 15 constitutes a part of the rear portion 47. More precisely, the internally hollow portion is integrally made in one single piece with the rear portion 47. The back surface 8 of the switching device 1 constitutes the base of the rear portion 47 which is "open" at the front. The front part 48 is at least partially open at the rear to permit connection of the control mechanism 82 to the moving element 81. The front part 48 is furthermore delimited at the front by what becomes the fore surface 9 of the switching device 1 once the same has been assembled.

With reference again to the section view of FIG. 2, the rear part 47 of the first casing 10 configures, for each pole, the upper breaking cavity 40 and lower breaking cavity 30 in addition to the supports for the moving element 81. The control mechanism 82 is housed inside the front part 48 from which a control lever 84 emerges at the front permitting manual operation of the mechanism or manual opening or closing of the pairs of contacts.

Again with reference to the section view of FIG. 2, the front part 48 has a rear surface 93 which defines one side of each breaking cavity 30 and 40 once the two parts 47, 48 of the first casing 10 have been assembled. In this way the only escape route for the gases generated inside the breaking cavities 30 and 40 is the route provided by the exhaust channels 24 and the upper discharge channels 29 respectively. Consequently the surface 93 substantially isolates the control mechanism 82 from the two breaking cavities 30 and 40 with obvious advantages in terms of reliability and duration of the mechanism itself.

Obviously the above represents a possible and therefore non-exclusive installation of the components inside the two parts 47, 48 constituting the first casing 10. Alternatively, the front part 48 could consist of a simple cover which closes at the front a rear part 47 shaped substantially like a container box. Analogously, the rear part 47 could consist of the simple back surface 8, while the front part 48 could consist of the remaining part of the first casing 10. In the same way the possibility of producing the first casing 10 in a number of parts greater than that indicated above should be considered part of the present invention.

The technical solutions adopted for the switching device according to the invention permit complete achievement of the set objectives. In particular, for each pole of the switching device, they allow easy and safe discharge of the gases generated inside the lower breaking cavity following an interruption operation. Said channels are furthermore advantageously isolated from the other component parts of the device which are not affected by the passage of the exhaust gases.

The switching device conceived as above is subject to numerous modifications and variations, all falling within the scope of the inventive concept; furthermore all the details can be replaced by other technical equivalents.

In practice, the materials used and the contingent dimensions and forms can be of any type according to requirements and the state of the art.

The invention claimed is:

1. Single-pole or multi-pole double break switching device for low voltage systems, said device comprising, for each pole, at least a first pair of contacts and at least a second pair of contacts, each pair comprising a stationary contact and a movable contact reciprocally couplable/decouplable at the level of a first breaking cavity and a second breaking cavity respectively; said device comprises at least a first casing inside which said breaking cavities are configured, wherein said first casing comprises a first surface with respect to which an internally hollow portion protrudes, said internally hollow portion comprising, for each pole, one or more exhaust channels each provided with a first section directly communicating with said first breaking cavity, each of said channels comprising a second section, opposite to said first section, communicating directly with the environment outside said first casing to permit the discharge of gas from the inside of said first breaking cavity; said internally hollow portion being integrally made with at least one portion of said first casing, said first breaking cavity being positioned between said second breaking cavity and said first surface;

wherein the one or more exhaust channels extends integrally and continuously from the first section to the second section;

wherein the device comprises a gas pathway from the origin of a gas within the device to the final exit of the device, the gas pathway being is an integral and continuously pathway;

wherein said first casing comprises a rear part and front part connected in a removable manner to each other, said rear part being integrally made with said internally hollow portion.

2. The switching device as claimed in claim 1, wherein said first casing comprises a back surface, substantially perpendicular to said first surface, and a fore surface opposite said back surface, said internally hollow portion protruding transversally from said first surface so as to be delimited at the rear by said back surface and at the front by a front surface substantially perpendicular to said first surface, said front surface being substantially parallel to said fore surface of said first casing.

3. The switching device as claimed in claim 1, wherein said internally hollow portion is made by moulding in one single piece with at least one portion of said first casing.

4. The switching device as claimed in claim 1, wherein, for each pole, said first casing is configured so that said first breaking cavity is delimited by said first surface, said first section of said one or more discharge channels being positioned at a level near to said first surface with reference to a vertical installation mode of said device.

5. The switching device as claimed in claim 1, comprising a second casing to contain an auxiliary and/or accessory device of said switching device, said second casing being coupled to said first casing at the level of said first surface and/or at the level of said front surface which delimits said internally hollow portion.

6. The switching device as claimed in claim 5, wherein said second casing is coupled with said first casing in a removable manner.

7. The switching device as claimed in claim 1, comprising a means for altering the chemical-physical characteristics of the gases to be discharged from said first lower breaking cavity.

8. The switching device as claimed in claim 7, wherein said means for altering the chemical-physical characteristics are operatively combined with said one or more discharge channels.

9. The switching device as claimed in claim 8, wherein said means for altering the chemical-physical characteristics of the gases consist of separation walls provided inside said one or more discharge channels.

10. The switching device as claimed in claim 9, wherein said separation walls are made of metallic material or material with gasifying properties.

11. The switching device as claimed in claim 1, wherein said first casing comprises a back surface, substantially perpendicular to said first surface and a fore surface opposite said back surface, said internally hollow portion protruding transversally from said first surface so as to be delimited at the rear by said back surface and at the front by a front surface substantially perpendicular to said first surface, said front surface being substantially parallel to said fore surface of said first casing.

12. The switching device as claimed in claim 2, wherein said internally hollow portion is made by moulding in one single piece with at least one portion of said first casing.

13. The switching device as claimed in claim 1, wherein, for each pole, said first casing is configured so that said first breaking cavity is delimited by said first surface, said first section of said one or more discharge channels being positioned at a level near to said first surface with reference to a vertical installation mode of said device.

14. The switching device as claimed in claim 2, wherein, for each pole, said first casing is configured so that said first breaking cavity is delimited by said first surface, said first section of said one or more discharge channels being positioned at a level near to said first surface with reference to a vertical installation mode of said device.

15. The switching device as claimed in claim 3, wherein, for each pole, said first casing is configured so that said first breaking cavity is delimited by said first surface, said first section of said one or more discharge channels being positioned at a level near to said first surface with reference to a vertical installation mode of said device.

16. The switching device as claimed in claim 1, comprising a second casing to contain an auxiliary and/or accessory device of said switching device, said second casing being coupled to said first casing at the level of said first surface and/or at the level of said front surface which delimits said internally hollow portion.

17. The switching device as claimed in claim 2, comprising a second casing to contain an auxiliary and/or accessory device of said switching device, said second casing being coupled to said first casing at the level of said first surface and/or at the level of said front surface which delimits said internally hollow portion.

18. The switching device of claim 1, said exhaust channels being extending without physical interruptions between said first and second sections, such that the inner walls of said exhaust channels have no discontinuity between said first and second sections.

* * * * *